US005913598A

United States Patent [19]

Hunt, Jr.

[11] Patent Number: 5,913,598

[45] Date of Patent: Jun. 22, 1999

[54] MOVIE SET LAMP PROTECTION AND SHIELDING SYSTEM

[76] Inventor: R. Dean Hunt, Jr., 2010 Keystone Blvd., North Miami, Fla. 33181

[21] Appl. No.: 08/958,967

[22] Filed: Oct. 28, 1997

[51] Int. Cl.[6] ..... F21V 11/00

[52] U.S. Cl. ..... 362/293; 362/278; 362/320

[58] Field of Search ..... 362/278, 293, 362/320, 294

[56] References Cited

U.S. PATENT DOCUMENTS

| | | | |
|---|---|---|---|
| 1,730,574 | 10/1929 | Holub | 362/293 X |
| 3,939,340 | 2/1976 | Gozzano et al. | 362/320 |
| 4,807,089 | 2/1989 | Nüssli | 362/17 |
| 5,154,503 | 10/1992 | Sternsher | 362/16 |
| 5,311,409 | 5/1994 | King | 362/17 |
| 5,371,663 | 12/1994 | Chuang | 362/280 |

*Primary Examiner*—Laura Tso

[57] ABSTRACT

A movie set lamp protection and shielding system is provided including a movie set lamp having a front face with a light and a rear extent. A transparent sheet is formed of a flexible and heat resistant material. A coupling mechanism is included for effecting the coupling between the sheet and the movie set lamp. During use, the sheet has a first mode of operation wherein the frame is situated over a top of the rear extent of the lamp such that the coupling mechanism is coupled therebetween for maintaining the system over the lamp for protecting the same. In a second mode of operation, the frame is situated over a front of the fins of the lamp such that coupling mechanism is mounted therebetween for maintaining the sysetm in front of the lamp for shielding heat of the lamp from a movie set situated in front thereof.

11 Claims, 4 Drawing Sheets

FIG 1
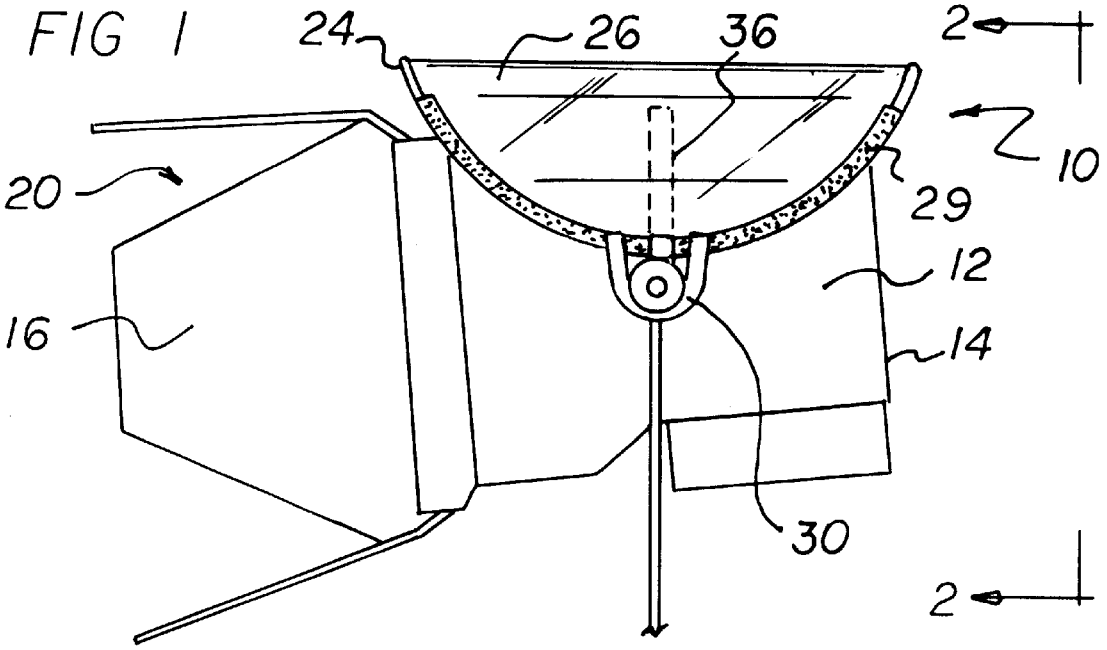
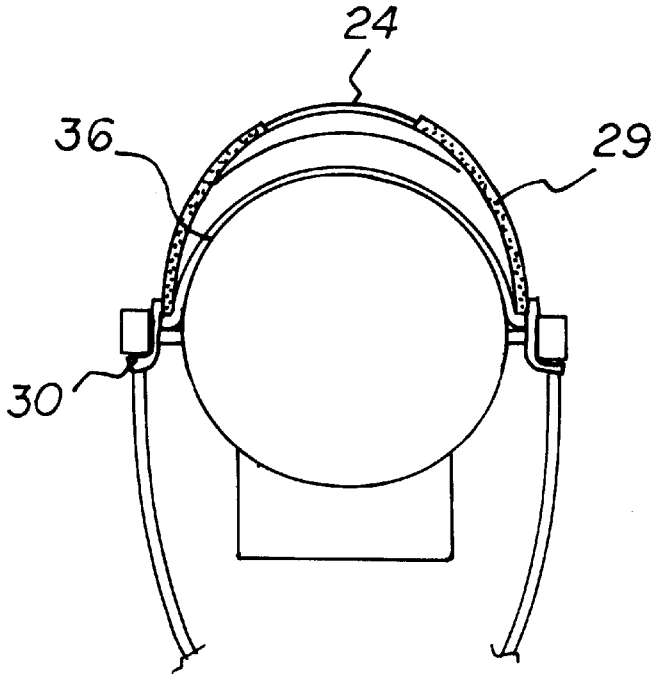
FIG 2

FIG 3
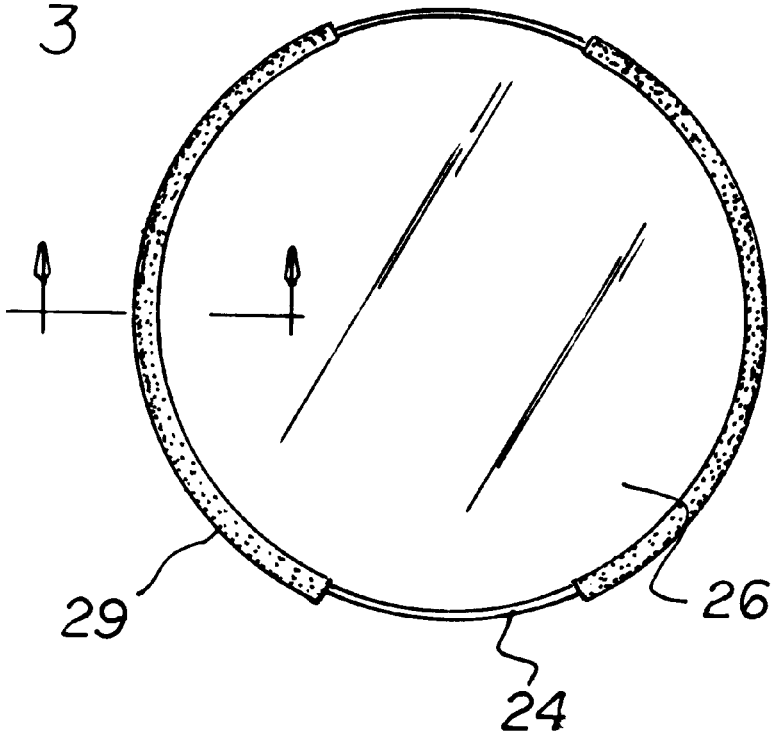
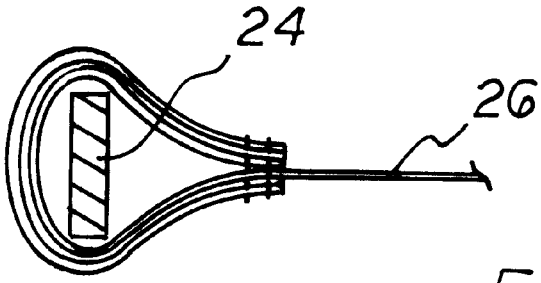
FIG 4
FIG 5
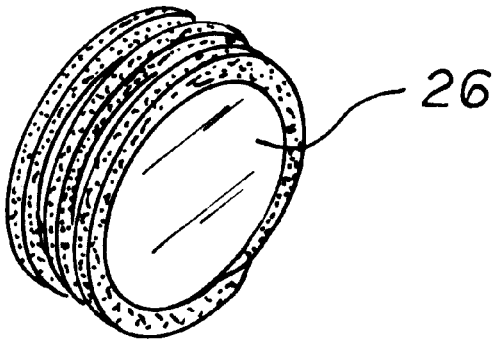

FIG 8
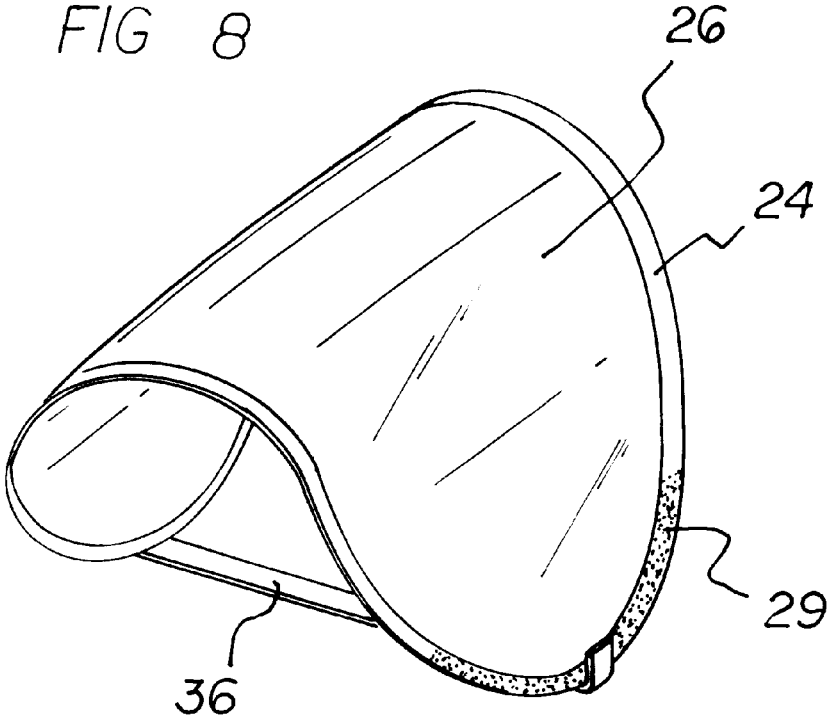
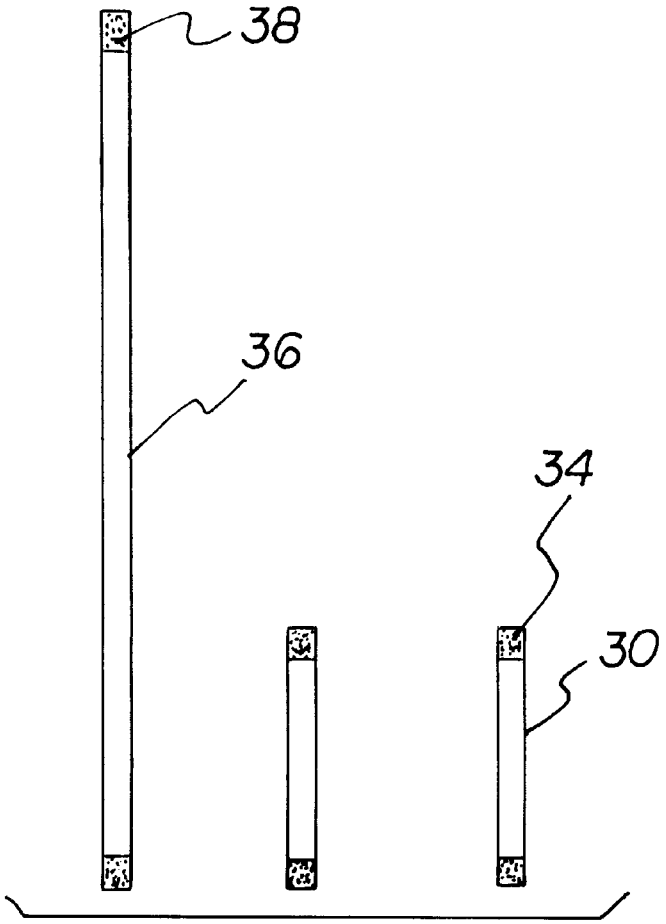
FIG 9

MOVIE SET LAMP PROTECTION AND SHIELDING SYSTEM

BACKGROUND OF THE INVENTION

1. Field of the Invention

The present invention relates to a movie set lamp protection and shielding system and more particularly pertains to protecting a lamp from various weather conditions and further shielding objects and persons on a movie set from heat generated by the lamp.

2. Description of the Prior Art

The use of various shades including vehicle windshield shades is known in the prior art. More specifically, vehicle windshield shades heretofore devised and utilized for the purpose of precluding the transfer of light therethrough are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,708,414; U.S. Pat. No. 5,122,906; U.S. Pat. No. 5,126,880; U.S. Pat. No. 5,128,838; U.S. Pat. No. 5,282,894; U.S. Pat. No. 5,276,600; U.S. Pat. No. 5,373,422; U.S. Pat. No. 5,436,804; and U.S. Pat. No. 3,867,019.

In this respect, the movie set lamp protection and shielding system according to the present invention substantially departs from the conventional concepts and designs of the prior art, and in so doing provides an apparatus primarily developed for the purpose of protecting a lamp from various weather conditions and further shielding a movie set from heat generated by the lamp.

Therefore, it can be appreciated that there exists a continuing need for a new and improved movie set lamp protection and shielding system which can be used for protecting a lamp from various weather conditions and further shielding a movie set from heat generated by the lamp. In this regard, the present invention substantially fulfills this need.

SUMMARY OF THE INVENTION

In view of the foregoing disadvantages inherent in the known types of vehicle windshield shades now present in the prior art, the present invention provides an improved movie set lamp protection and shielding system. As such, the general purpose of the present invention, which will be described subsequently in greater detail, is to provide a new and improved movie set lamp protection and shielding system which has all the advantages of the prior art and none of the disadvantages.

To attain this, the present invention essentially comprises a movie set lamp having a rear extent with a cylindrical configuration. As shown in FIGS. 1 & 6, the lamp includes a circular rear face and a tubular periphery integrally coupled to the rear face and extending forwardly therefrom. As such, an interior space and an open front is defined for housing a high intensity light. The movie set lamp further has a support stand coupled to the periphery and extending downwardly therefrom for supporting the lamp at an elevated orientation. The lamp further includes a plurality of planar fins coupled to the periphery of the lamp and extending forwardly therefrom. The fins thus function for directing light forwardly. As shown in FIG. 1, each fin has a rear linear long edge, a front linear short edge, and a pair of tapering linear side edges formed therebetween. The fins form a generally cubical shaped area in front of the lamp. Next provided is a flexible resilient frame having an annular closed-loop configuration and a uniform rectangular cross-section. Note FIG. 4. The frame has a first diameter and is adapted to be folded into a plurality of circular portions. Each of such portions has a common second diameter less than the first diameter. When folded, the circular portions reside in concentric relationship with respect to each other, as can be seen in FIG. 5. A planar transparent sheet is provided having a circular configuration with a first circular face, a second circular face and a circular periphery formed therebetween. The transparent sheet is constructed from a heat-resistant, flexible, and smooth material. The sheet has a periphery folded radially inward and coupled to one of the faces to form a closed annular sleeve through which the frame is situated. With reference now to FIGS. 3 & 4, a pair of pile fasteners are provided each having a rectangular configuration. Each of the pair of pile fasteners has a rear face with an adhesive formed thereon which in turn is adhered to the sleeve of the transparent sheet. When mounted on the sleeve, each of the fasteners extend over both faces of the transparent sheet by at least 1 inch. The pair of pile fasteners are spaced about the periphery of the sheet such that a pair of 40 degree arcs are defined therebetween. FIG. 9 shows a pair of short straps each constructed from a flexible, inelastic material. Such straps each form a planar rectangular configuration. For reasons that will become apparent hereinafter, each of the short straps has a pile fastener mounted on each of a pair of ends thereof. With reference still to FIG. 9, an elongated strap is shown. Similar to the short straps, the elongated strap is constructed from a flexible, inelastic material and forms a planar rectangular configuration. It should be noted that the elongated strap has a length of at least 3 times that of the short straps. Further, the elongated strap is equipped with a pile fastener mounted on each of a pair of ends thereof. FIG. 7 shows a flexible enclosure having a square front face, a square rear face, and a thin periphery formed therebetween. Accordingly, the enclosure defines an interior space and an open top for removably receiving the apparatus when the frame is folded. The enclosure further has a rectangular lid integrally coupled to a top edge of the rear face with a tab extending therefrom. The lid has a first coupling means attached thereto. The front face has a complimentary second coupling means mounted adjacent a top edge thereof for releasably coupling with the first coupling means to selectively close the lid.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved movie set lamp protection and shielding system which has all the advantages of the prior art vehicle windshield shades and none of the disadvantages.

It is another object of the present invention to provide a new and improved movie set lamp protection and shielding system which may be easily and efficiently manufactured and marketed.

It is a further object of the present invention to provide a new and improved movie set lamp protection and shielding system which is of a durable and reliable construction.

An even further object of the present invention is to provide a new and improved movie set lamp protection and shielding system which is susceptible of a low cost of manufacture with regard to both materials and labor, and which accordingly is then susceptible of low prices of sale to the consuming public, thereby making such movie set lamp protection and shielding system economically available to the buying public.

Still yet another object of the present invention is to provide a new and improved movie set lamp protection and shielding system which provides in the apparatuses and methods of the prior art some of the advantages thereof, while simultaneously overcoming some of the disadvantages normally associated therewith.

Still another object of the present invention is to protect a lamp from various weather conditions and further shielding a movie set from heat generated by the lamp.

Lastly, it is an object of the present invention to provide a new and improved movie set lamp protection and shielding system including a movie set lamp having a front face with a light and a rear extent. A transparent sheet is formed of a flexible and heat resistant material. A coupling mechanism is included for effecting the coupling between the sheet and the movie set lamp. During use, the sheet has a first mode of operation wherein the frame is situated over a top of the rear extent of the lamp such that the coupling mechanism is coupled therebetween for maintaining the system over the lamp for protecting the same. In a second mode of operation, the frame is situated over a front of the fins of the lamp such that coupling mechanism is mounted therebetween for maintaining the system in front of the lamp for shielding heat of the lamp from a movie set situated in front thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the movie set lamp protection and shielding system constructed in accordance with the principles of the present invention.

FIG. 2 is a rear view of the lamp of the present invention.

FIG. 3 is a front view of the sheet.

FIG. 4 is a cross-sectional view of the frame and sleeve of the present invention taken along the line shown in FIG. 3.

FIG. 5 is a perspective view of the sheet and frame in the folded orientation.

FIG. 8 is a perspective view of the sheet maintained in a bent orientation by way of the elongated strap.

FIG. 9 is an illustration of the various straps associated with the present invention.

Similar reference characters refer to similar parts throughout the several views of the drawings.

DESCRIPTION OF THE PREFERRED EMBODIMENT

Figure 6:
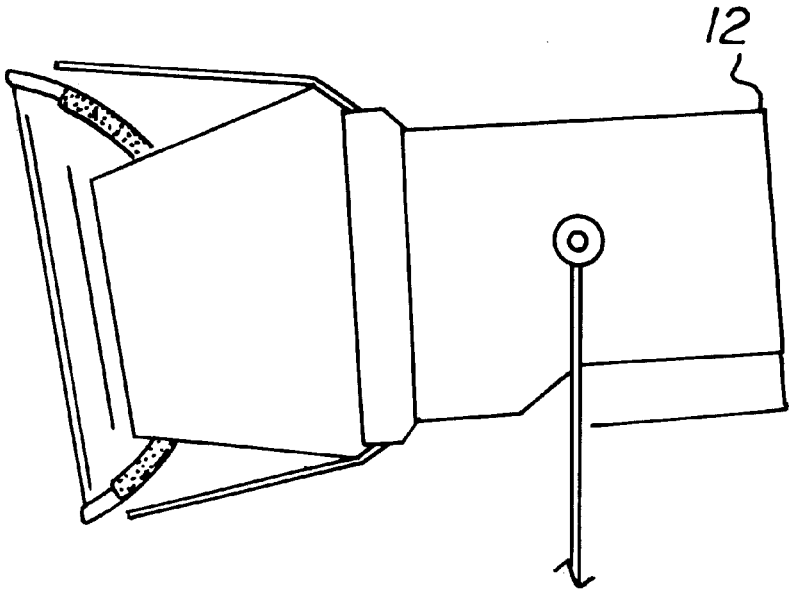
FIG. 6 is a side view of the lamp of the present invention.

With reference now to the drawings, and in particular to FIG. 1 thereof, a new and improved movie set lamp protection and shielding system embodying the principles and concepts of the present invention and generally designated by the reference numeral 10 will be described.

The present invention, the new and improved movie set lamp protection and shielding system, is comprised of a plurality of components. Such components in their broadest context include a movie set lamp, frame, transparent sheet, and pile fasteners. Such components are individually configured and correlated with respect to each other so as to attain the desired objective.

More specifically, it will be noted that the system 10 of the present invention includes a movie set lamp 12 having a rear extent 14 with a cylindrical configuration. As shown in FIGS. 1 & 6, the lamp includes a circular rear face and a tubular periphery integrally coupled to the rear face and extending forwardly therefrom. As such, an interior space and an open front is defined for housing an unillustrated high intensity light. To allow ventilation of the lamp, an unillustrated opening, or vent, is formed in a top of the periphery. The movie set lamp further has a support stand coupled to the periphery and extending downwardly therefrom for supporting the lamp at an elevated orientation.

The lamp further includes a plurality of planar fins 16 coupled to the periphery of the lamp and extending forwardly therefrom. The fins thus function for directing light forwardly. As shown in FIG. 1, each fin has a rear linear long edge, a front linear short edge, and a pair of tapering linear side edges formed therebetween. The fins form a generally cubical shaped area 20 in front of the lamp.

Next provided is a flexible resilient frame 24 having an annular closed-loop configuration and a uniform rectangular cross-section. Note FIG. 4. In an alternative embodiment, the frame may be constructed with a rectangular configuration. A length of the cross-section is preferably 4 times the width thereof, as shown in FIG. 4. In the preferred embodiment, the frame is constructed from a metal material and is maintained in a closed loop by way of a metal crimp or buttweld. The frame has a first diameter and is adapted to be folded into a plurality of circular portions. Such function is similar to that associated with various shades in the art of vehicle windshield shades. Each of such circular portions has a common second diameter less than the first diameter. In the preferred embodiment, the first diameter is approximately 25 inches. When folded, the circular portions reside in concentric relationship with respect to each other, as can be seen in FIG. 5. Preferably, the frame is sized to be capable of folding into at least three circular portions.

A planar transparent sheet 26 is provided having a circular configuration with a first circular face, a second circular face and a circular periphery formed therebetween. The transparent sheet is constructed from a heat-resistant, flexible, and smooth material. The sheet has a periphery folded radially inward and coupled to one of the faces to form a closed annular sleeve 28 through which the frame is situated. The sheet couples to itself preferably by way of a double stitching.

Ideally, the transparent sheet is formed of a plastic called KORTON PFA which is manufactured by Norton Performance Plastics. Such plastic is fluoropolymer film characterized by the highest continuous service temperature of all meltable fluoropolymer films, superior retention of mechanical properties to temperatures as high as 500 degrees, resistance to chemicals and solvents, and a low friction non-wetting surface. As an option, such material may be dyed during manufacture thus rendering a tint for light alteration. As yet another option, the plastic film may be treated to preclude the passage of UV rays.

With reference now to FIGS. 3 & 4, a pair of pile fasteners 29 are provided each having a rectangular configuration. Each of the pair of pile fasteners has a rear face with an adhesive formed thereon which in turn is adhered to the sleeve of the transparent sheet. When mounted on the sleeve, each of the fasteners extend over both faces of the transparent sheet by at least 1 inch. The pair of pile fasteners are spaced about the periphery of the sheet such that a pair of 40 degree arcs are defined therebetween.

FIG. 9 shows a pair of short straps 30 each constructed from a flexible, inelastic material. Such straps each form a planar rectangular configuration. For reasons that will become apparent hereinafter, each of the short straps has a pile fastener 34 mounted on each of a pair of ends thereof.

With reference still to FIG. 9, an elongated strap 36 is shown. Similar to the short straps, the elongated strap is constructed from a flexible, inelastic material and forms a planar rectangular configuration. It should be noted that the elongated strap has a length of at least 3 times that of the short straps. Further, the elongated strap is equipped with a pile fastener 38 mounted on each of a pair of ends thereof.

Figure 7:
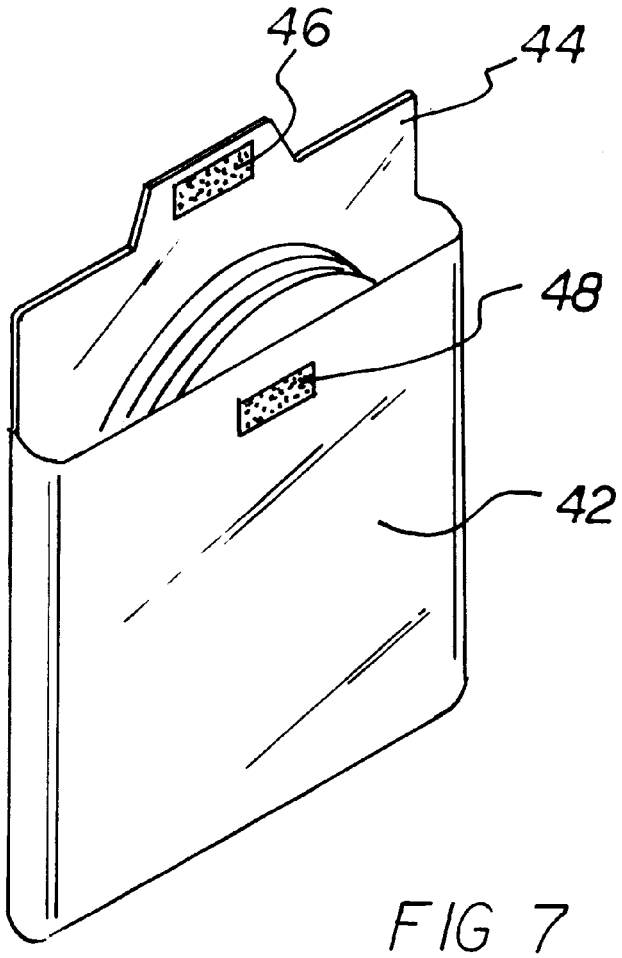
FIG. 7 is a perspective view of the enclosure of the present invention.

FIG. 7 shows a flexible scrim enclosure 42 having a square front face, a square rear face, and a thin periphery formed therebetween. Accordingly, the enclosure defines an interior space and an open top for removably receiving the apparatus when the frame is folded. Preferably, a square rigid cardboard sheet is attached to the front face for ensuring that the enclosure maintains its shape. For reasons that will become apparent hereinafter, the width and height of each of the front and rear faces is at least the second diameter. The enclosure further has a rectangular lid 44 integrally coupled to a top edge of the rear face with a tab extending therefrom. The lid has a first coupling means 46 attached thereto. The front face has a complimentary second coupling means 48 mounted adjacent a top edge thereof for releasably coupling with the first coupling means to selectively close the lid. In the preferred embodiment, the first and second coupling means both preferably take the form of a pile type fastener. As an option, a bore may be centrally formed in the rectangular tab for hanging purposes.

In use, the present invention has a first mode of operation wherein the frame is bent to define a portion of a horizontally oriented cylinder. The frame is maintained in such orientation by way of the elongated strap. This is accomplished by the pile fasteners of the ends of the elongated straps being removably coupled to the pile fasteners of the frame at diametrically opposite positions thereon. Note FIG. 8. When the frame is in such orientation, the frame is conveniently situated over a top of the rear extent of the lamp. As shown in FIGS. 1 & 2, each of the short straps are looped about a corresponding post of the support stand of the lamp and subsequently attached to the pile fastener of the frame. It should be noted that the portions of the stand which the small straps encompass are a pair of radially extending side posts. In the present mode, the straps thus maintain the system over the lamp for protecting the same from rain or the like.

In a second mode of operation, the frame is bent to define a portion of a vertically oriented cylinder and is situated over a front of the fins of the lamp. As shown in FIG. 6, the frame abuts an interior face of opposite side fins of the lamp. This maintains the system in front of the lamp for shielding heat of the lamp from a movie set situated in front thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved movie set lamp protection and shielding system comprising, in combination:

a movie set lamp having a rear extent with a cylindrical configuration including a circular rear face and a tubular periphery integrally coupled to the rear face and extending forwardly therefrom for defining an interior space and an open front for housing a high intensity light situated therein, the movie set lamp further having a support stand coupled to the periphery and extending downwardly therefrom for supporting the lamp at an elevated orientation, the lamp further including a plurality of planar fins coupled to the periphery thereof and extending forwardly therefrom for directing light forwardly, each fin having a rear linear long edge, a front linear short edge, and a pair of tapering linear side edges formed therebetween, wherein the fins form a generally cubical shaped area in front of the lamp;

a flexible resilient frame having an annular closed-loop configuration and a uniform rectangular cross-section, the frame having a first diameter and adapted to be folded into a plurality of circular portions each with a common second diameter less than the first diameter and in concentric relationship with respect to each other;

a planar transparent sheet having a circular configuration with a first circular face, a second circular face and a circular periphery formed therebetween, the transparent sheet constructed from a heat-resistant, flexible, and smooth material, the sheet having a periphery folded radially inward and coupled to one of the faces to form a closed annular sleeve through which the frame is situated, the transparent sheet having a pair of pile fasteners each having a rectangular configuration, each of the pair of pile fasteners having a rear face with an adhesive formed thereon adhered to the sleeve of the transparent sheet to extend over both faces of the transparent sheet, the third pair of pile fasteners spaced about the periphery of the sheet such that a pair of 40 degree arcs are defined therebetween; and a pair of short straps each constructed from a flexible, inelastic material and forming a planar rectangular configuration, each of the short straps having a pile fastener mounted on each of a pair of ends thereof;

an elongated strap constructed from a flexible, inelastic material and forming a planar rectangular configuration, the elongated strap having a lenth of at least 3 times that of the short straps, the elongated strap having a pile fastener mounted on each of a pair of ends thereof;

a flexible enclosure having a square front face, a square rear face, and a thin periphery formed therebetween for defining an interior space and an open top for removably receiving the apparatus when the frame is folded, the enclosure further having a rectangular lid integrally coupled to a top edge of the rear face with a tab extending therefrom having a first coupling means attached thereto, the front face having a second coupling means mounted adjacent a top edge thereof for releasably coupling with the first coupling means for selectively closing the lid;

whereby the apparatus has a first mode of operation wherein the frame is bent to define a portion of a horizontally oriented cylinder and is maintained in such orientation by way of the elongated strap after which the frame is situated over a top of the rear extent of the lamp such that each fo the short straps are looped about a corresponding post of the support stand of the lamp and further attached to the pile fastener of the frame for maintaining the system over the lamp for protecting the same and a second mode of operation wherein the frame is bent to define a portion of a vertically oriented cylinder and is situated over a front of the fins of the lamp such that frame abuts an interior face of opposite side faces of the lamp for maintaining the system in front of the lamp for shielding heat of the lamp from a movie set situated in front thereof.

2. A shielding system comprising:

a frame having a closed-loop configuration, the frame adapted to be folded into a plurality of smaller portions; and a sheet coupled to the frame;

said sheet being transparent for allowing the passage of light therethrough but precluding the transfer of heat therethrough.

3. A shielding system as set forth in claim 2 wherein the periphery of the sheet defines a sleeve through which the frame is situated.

4. A shielding system as set forth in claim 2 wherein the system has a coupling means formed thereon for releasably coupling with a piece of movie set equipment.

5. A shielding system as set forth in claim 4 wherein the piece of movie set equipment is a lamp.

6. A shielding system as set forth in claim 4 wherein the coupling means incudes at least one pile type fastener.

7. A shielding system as set forth in claim 6 wherein the pile type fasteners are mounted on a periphery of the sheet.

8. A shielding system as set forth in claim 7 wherein a pair of short straps are provided for coupling with the pile fasteners of the sheet thereby mounting the frame to the piece of movie set equipment.

9. A shielding system as set forth in claim 7 wherein an elongated strap is provided for coupling with the pile fasteners of the sheet to maintain the frame in a bent orientation.

10. A shielding system as set forth in claim 2 wherein the sheet is constructed from a heat-resistant material.

11. A movie set lamp protection and shielding system comprising:

a movie set lamp having a front face with a light and a rear extent; and a transparent sheet formed of a heat resistant material; and coupling means for effecting the coupling between the sheet and the movie set lamp;

whereby the sheet has a first mode of operation wherein the frame is situated over a top of the rear extent of the lamp such that the coupling means is coupled therebetween for maintaining the system over the lamp for protecting the same and a second mode of operation wherein the frame is situated over a front of the fins of the lamp such that the coupling means is mounted therebetween for maintaining the system in front of the lamp for shielding heat of the lamp from a movie set situated in front thereof.

* * * * *